US008764250B2

(12) United States Patent
Dalsgaard

(10) Patent No.: US 8,764,250 B2
(45) Date of Patent: Jul. 1, 2014

(54) LIGHT FIXTURE WITH ROTATABLE BEAM FRAMING

(75) Inventor: Carsten Dalsgaard, Silkeborg (DK)

(73) Assignee: Martin Professional A/S, Aarhus N. (DK)

( * ) Notice: Subject to any disclaimer, the term of this patent is extended or adjusted under 35 U.S.C. 154(b) by 267 days.

(21) Appl. No.: 13/394,924

(22) PCT Filed: Sep. 10, 2010

(86) PCT No.: PCT/DK2010/050229

§ 371 (c)(1), (2), (4) Date: Apr. 26, 2012

(87) PCT Pub. No.: WO2011/029448

PCT Pub. Date: Mar. 17, 2011

(65) Prior Publication Data

US 2012/0218767 A1 Aug. 30, 2012

(30) Foreign Application Priority Data

Sep. 11, 2009 (DK) ..... 2009 01015

(51) Int. Cl.
*F21V 11/18* (2006.01)
*F21V 11/16* (2006.01)

(52) U.S. Cl.
CPC ..... *F21V 11/18* (2013.01); *F21V 11/16* (2013.01)
USPC ..... 362/321

(58) Field of Classification Search
CPC ..... F21V 11/18; F21V 17/02; F21V 11/10; F21V 14/085; F21V 14/08; F21V 11/08; F21V 11/16; F21W 2131/406
See application file for complete search history.

(56) References Cited

U.S. PATENT DOCUMENTS

| | | | | |
|---|---|---|---|---|
| 4,626,969 | A | 12/1986 | Kristofek | |
| 4,729,071 | A | 3/1988 | Solomon | |
| 5,113,332 | A * | 5/1992 | Richardson | 362/282 |
| 6,939,026 | B2 * | 9/2005 | Gennrich et al. | 362/322 |

(Continued)

FOREIGN PATENT DOCUMENTS

| | | |
|---|---|---|
| CN | 2509445 Y | 9/2002 |
| FR | 02843628 | 2/2004 |

(Continued)

OTHER PUBLICATIONS

International Search Report; International Application No. PCT/DK2010/050229; International Filing Date Sep. 10, 2010; 2 pages.
Danish Search Report; Danish Application No. PA200901015; Filing Date Sep. 11, 2009; 2 pages.

(Continued)

*Primary Examiner* — Bao Q Truong
(74) *Attorney, Agent, or Firm* — Blank Rome LLP

(57) ABSTRACT

The present invention relates to a framing system for delimiting a light beam. The framing system comprises a base support rotatable supporting a frame support. The frame support comprises:

a number of shutter blades surrounding the light beam;

a number of actuators adapted to moved the shutter blades in and out of said light beam.

The framing system comprises further rotatable electric connecting means, the rotatable electric connecting enabling transferring of electric energy between said frame support and said base support during rotation of said frame support in relation to said base support. The present invention relates also to a light fixture comprising the framing system and a method of delimiting a light beam.

10 Claims, 7 Drawing Sheets

(56) References Cited

U.S. PATENT DOCUMENTS

| | | | | |
|---|---|---|---|---|
| 7,033,047 | B2 * | 4/2006 | Gennrich et al. | 362/321 |
| 7,736,025 | B2 * | 6/2010 | Hofmann et al. | 362/293 |
| 2003/0076681 | A1 | 4/2003 | Rasmussen et al. | |
| 2005/0047147 | A1 * | 3/2005 | Gennrich et al. | 362/321 |
| 2005/0047148 | A1 | 3/2005 | Gennrich et al. | |
| 2006/0072326 | A1 | 4/2006 | Rodriquez et al. | |
| 2006/0187654 | A1 | 8/2006 | Jungel-Schmid | |
| 2007/0046905 | A1 * | 3/2007 | Takeuchi et al. | 353/97 |

FOREIGN PATENT DOCUMENTS

| | | |
|---|---|---|
| GB | 449221 | 6/1936 |
| GB | 499221 | 7/1937 |
| GB | 499221 | 1/1939 |
| JP | H10255503 | 9/1998 |
| JP | 2008177020 | 7/2008 |
| WO | WO96/36834 | 11/1996 |
| WO | WO9636834 | 11/1996 |
| WO | WO0184043 | 11/2001 |
| WO | WO03/023513 | 3/2003 |
| WO | WO03023513 | 3/2003 |
| WO | WO2007/134609 | 11/2007 |
| WO | WO2007134609 | 11/2007 |

OTHER PUBLICATIONS

JP2008177020 Patent Abstract; "Light Source Device, Image Display Device, and Projector"; 2 pages.

Extended European Search Report; Dated: Aug. 5, 2013; European Application No. EP10815017.8, which corresponds to this application; 11 pages.

Extended European Search Report; Dated: Aug. 5, 2013; European Application No. EP10815018.6, which corresponds to related U.S. Appl. No. 13/394,939; 10 pages.

English abstract; Japanese Patent Publication No. JPH10255503; Publication Date: Sep. 25, 1998; 1 page.

First Office Action; Chinese Patent Application No. 201080039052X; Filing Date: Sep. 10, 2010; 4 pages.

English translation of First Office Action; Chinese Patent Application No. 201080039052X; 4 pages.

Chinese Search Report; Chinese Patent Application No. 201080039052X; Filing Date: Sep. 10, 2010; 2 pages.

English translation of Search Report; Chinese Patent Application No. 201080039052X; 2 pages.

English Abstract; Chinese Patent Application No. CN2509445Y; 1 page.

English Abstract; Japanese Patent Application No. JP2008-177020; 2 pages.

* cited by examiner

LIGHT FIXTURE WITH ROTATABLE BEAM FRAMING

FIELD OF THE INVENTION

The present invention relates to a framing system for delimiting/shaping a light beam and to light fixtures comprising such framing system.

BACKGROUND OF THE INVENTION

Framing systems for delimiting a light beam where a number of shutter blades are moved in and out of the light beam in order to adjust the shape of the beam have been known for many years.

Typical framing systems have a number of shutter blades which can be moved in and out of the light beam by a number of actuators. The light beam is shaped/delimited/framed by adjusting the position of each shutter blade relatively to the light beam and thereby achieving the wanted framing of the light beam. The framing systems are typically used in light fixtures such as moving heads, follow spots and spot lights generating a light beam. Such light fixtures comprise a light source generating a light beam and a number of optical components generating different optical effects.

WO9636834, WO03023513, WO07134609, disclose framing systems according to prior art where a number of shutter blades surrounds the light beam and can be moved in and out of the light beam by a number of actuators. The shutter blades and actuators are mounted on a frame support rotatable carried by a base support. These framing systems are used in light fixtures having a light source generating a light beam, a lens system for focusing and/or zooming the light beam and controlling means (CPU; microprocessors, microcontrollers, PLD or the like) for controlling the components of the light fixture. Light fixtures with framing system are often used in connection with stages where a part of the stage or a performer needs to be illuminated. The light beam is framed such that the light beam only illuminates the desired part of the stage or the performer. The light fixtures are typical set up prior to the show by physical positioning the light fixtures and/or by programming the light fixtures through a light controller communicating with the controlling means of the light fixture. This process is often very time-consuming as an operator manually performs the framing of the light beams, especially in huge shows with a large number of light fixtures. The framing systems can be adjusted in a large variety of patterns as the shutter blades can be moved individually in and out of the light beam and the frame support can also be rotated relative to the light beam. However there are some limitations when framing the light beam as the frame support can only be rotated approximately 45 degrees due to mechanical restrictions around the light beam and the movement of the shutter blades are also limited in there movement. There can thus be some situations where the light fixture cannot frame the light beam as desired and the result is that the light fixture needs to be physical moved in order to frame the desired areas, which is very time consuming. This physical movement can in connection with moving heads automatically be performed through the light controller, however this often need rotation of the head and yoke and reprogramming of the light show is thus needed-which is also very time consuming. Additional as a result of the blade rotation limitation, smooth morphing in between many different framing shapes is also limited.

WO0184043 discloses a lighting fixture projecting a light beam for spot lighting in theater stages, cinema and television studios and the like. The fixture includes a light source at one end of a housing having a light beam exit aperture at the opposite end thereof, the light source and aperture being arranged generally concentric with a longitudinal or optical axis of the lighting fixture. One or more beam-shaping blades and preferably also other light beam influencing elements, such as one or more lenses, an iris, and/or a pattern or gobo, are arranged along the path of the light beam along the longitudinal axis through the housing from the light source to the aperture. The position of the beam-shaping blade or blades, and preferably of all the light beam influencing elements, is adjustable relative to the longitudinal axis. The fixture produces a well-defined light beam or light cone with geometry, angle of conicity and focal point that may be altered manually or by remote control. A number of adjustment rings surrounds the light fixture and interacts with the shutter blades through a complicated mechanical system. The shutter blades can be moved in and out of the light beam by rotating the adjustment rings. The disclosed beam-shaping device are very complicated to construct as each shutter blade comprises a large number of components which need to interact in order to shape the light beam using the adjustment rings. This beam-shaping device takes further up a lot of space and it is impossible to integrate inside a light fixture as the adjustment rings need to be positioned outside the housing.

DESCRIPTION OF THE INVENTION

The object of the present invention is to solve to above described limitations related to prior art framing systems. This is achieved by a framing system, light fixture and method as described in the independent claims. The dependent claims describe possible embodiments of the present invention. The advantages and benefits of the present invention are described in the detailed description of the invention.

DETAILED DESCRIPTION OF THE INVENTION

Figure 1:
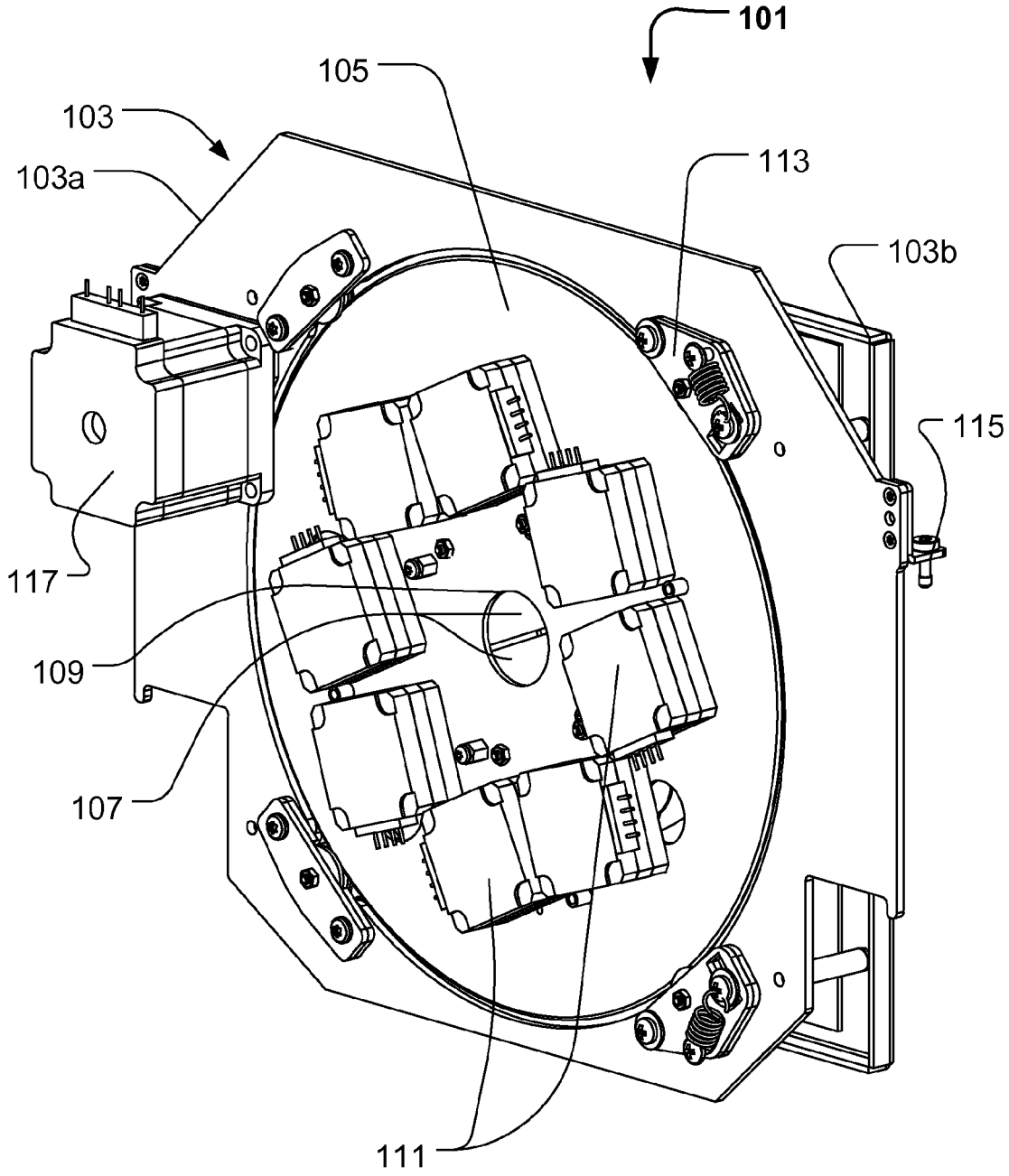
FIG. 1 illustrates a perspective view of a framing system according to the present invention.

FIG. 1 illustrates a perspective view of a framing system 101 according to the present invention. The framing system 101 comprises a base support 103 rotatable supporting a frame support 105. The frame support comprises, a number of shutter blades 107 surrounding an aperture 109 for a light beam (not shown) and a number of actuators 111 adapted to moved the shutter blades in and out of the aperture 109 and thus also in and out of the light beam the light beam.

The base support comprises a first support plate 103*a* and a second support plate 103*b*. The first support plate comprising a number of pulley systems 113 rotatable carrying the frame support 105, hinging means 115 for mounting the framing system in a light fixture, and an actuator 117 intermeshing with the frame support.

The shutter blades 107 and actuators 111 can be embodied as known in the prior art for instance as described in WO9636834, WO03023513 or WO07134609 incorporated herein by reference. The shutter blades can also be embodied as described in the applicants pending application DK PA 2010 00034 also incorporated by reference. The shutter blades can for instance, as described in WO07134609, be a merged pile, where the shutter blades in the merged pile are placed with the front area placed over the front area of a first neighboring shutter blade and the front area placed below the front area of the second neighboring shutter blade. Forming the shutter means in a merged pile leads to a very thin assembly, where the operating edges of the shutters are operating in the same plane. This can lead to a uniform sharp limitation of a projected light beam. In a projector, the thin assembly can be placed physically close to further light forming means, which also has to operate near an optical focus plane. The framing system according to the present invention are useful in connection with shutter blades merged in a pile as this kind of shutter blades are limited in their movements due the merging and the 360 degrees rotation (described below) of the framing system is eliminates these limitations.

Figure 2:
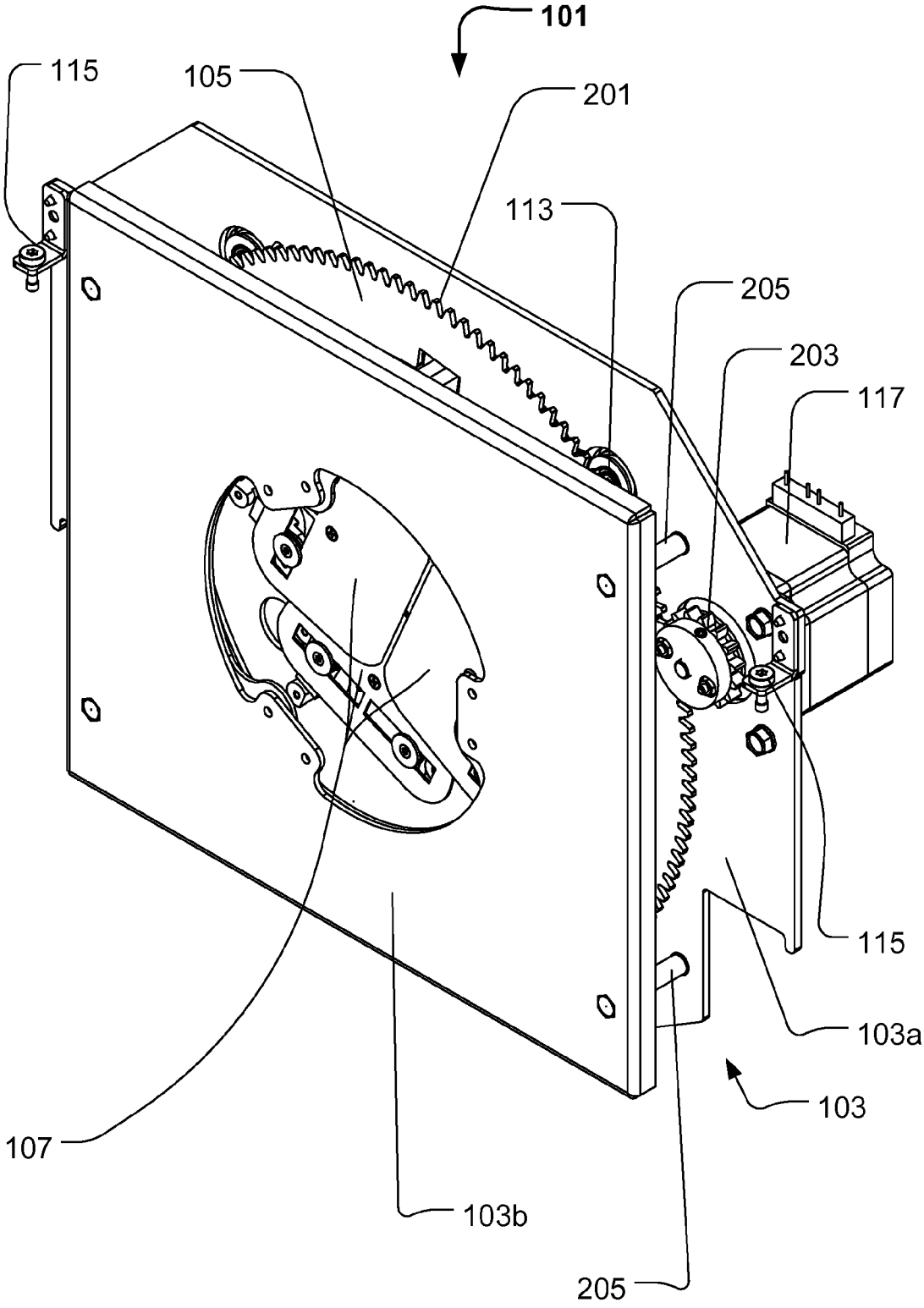
FIG. 2 illustrates a perspective view of the framing system in FIG. 1 from the opposite side.

FIG. 2 illustrates a perspective view of the framing system in FIG. 1 from the opposite side and illustrates that the framing support 105 comprises a toothed edge 201 intermeshing with a toothed wheel 203 rotatable by actuator 117. The toothed edge 201 is distributed 360 degrees around the frame support and actuator 117 can thus continuously/endless rotate the framing support more than 360 degrees around the light beam. FIG. 2 further illustrates that the first support plate 103*a* and the second support plate 103*b* are connected and separated by a number of spacers 205 and that the framing support 105 is positioned between the first and second support plates.

Figure 3:
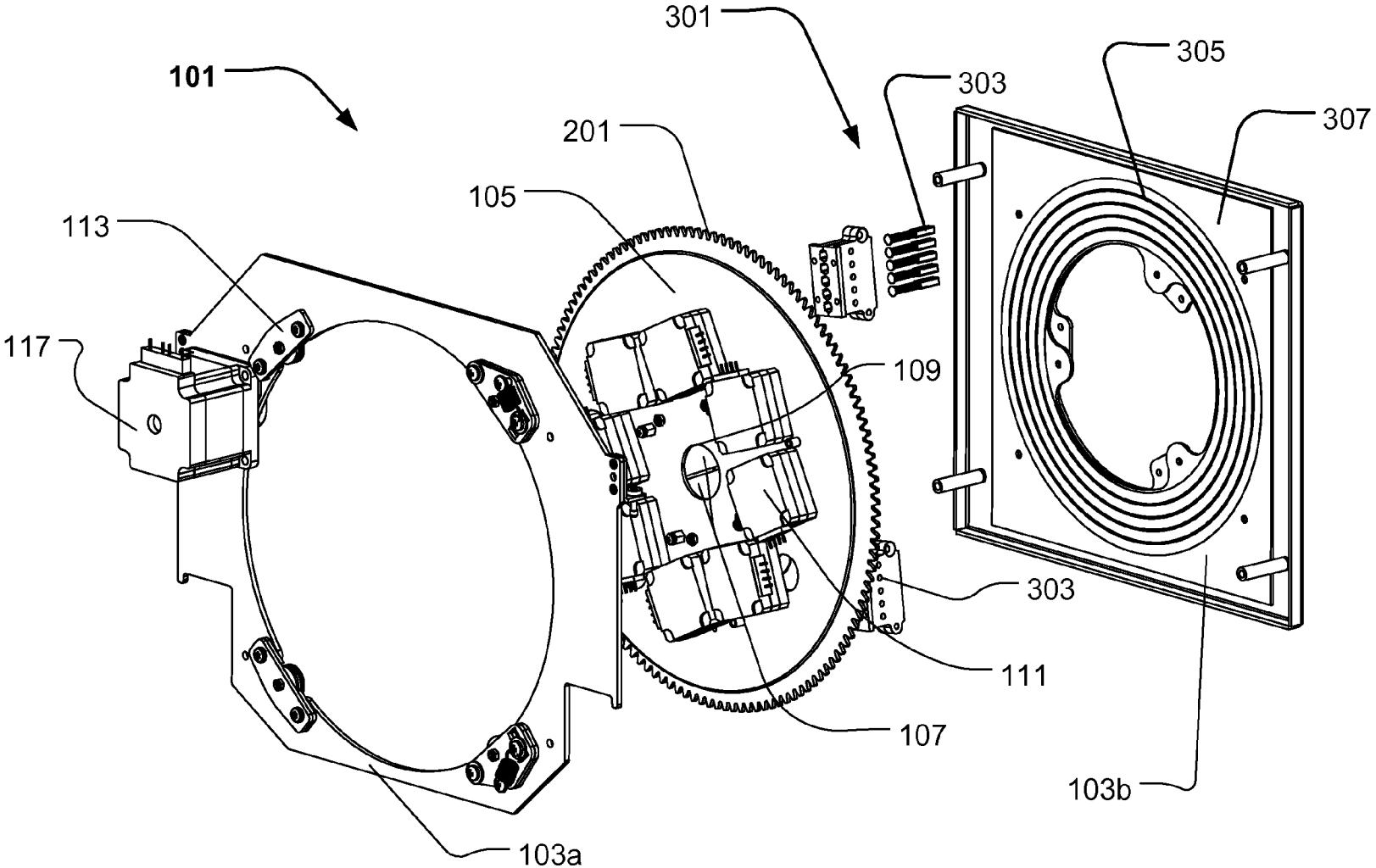
FIG. 3 illustrates a perspective and exploded view of the framing system in FIG. 1.
Figure 4:
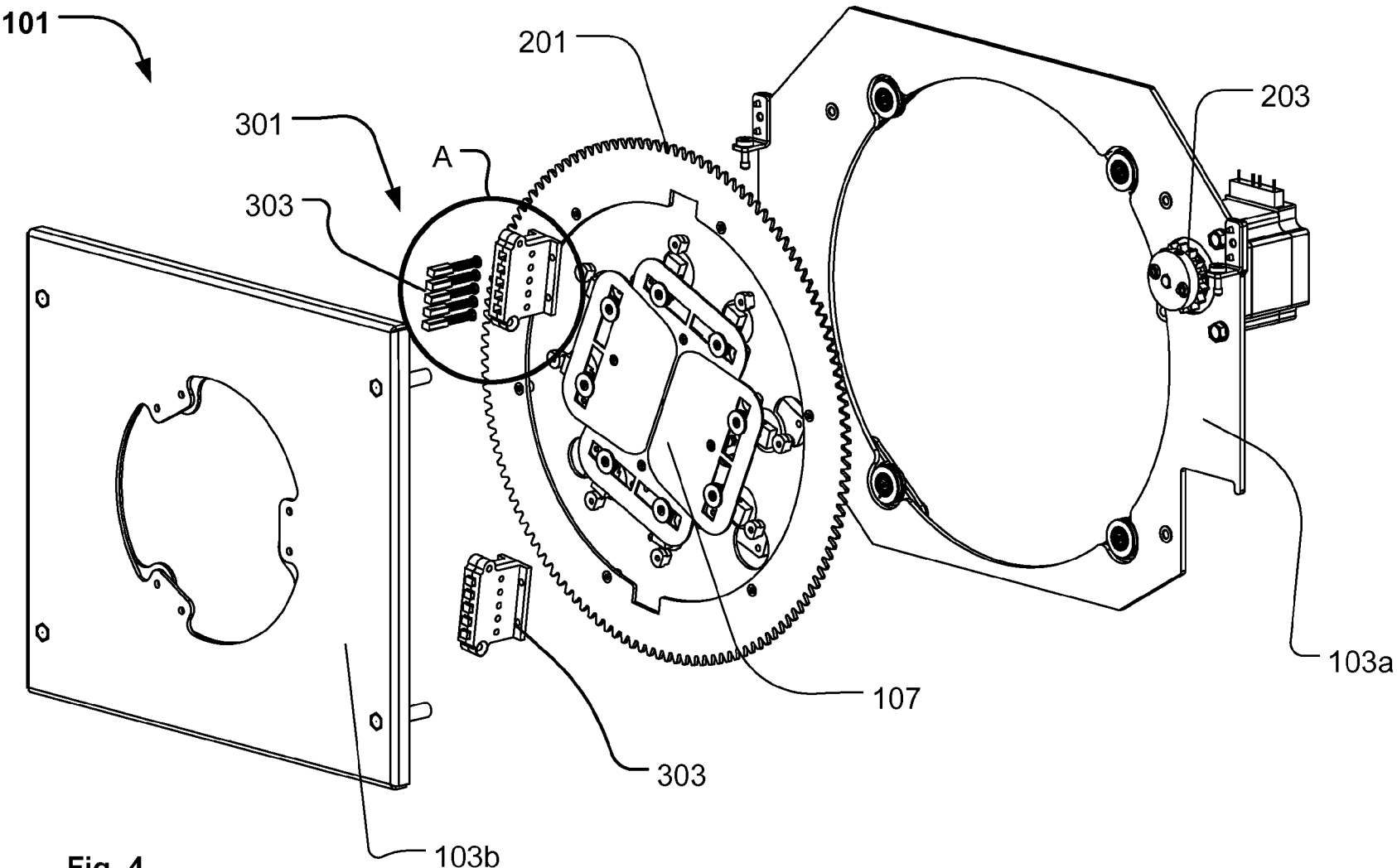
FIG. 4 illustrates a perspective and exploded view of the framing system in FIG. 2.

FIGS. 3 and 4 illustrates an exploded view of the framing system in FIG. 1 and FIG. 2 respectively. FIG. 3 illustrates that the framing system comprises rotatable electric connecting means 301. The rotatable electric connecting means enables transferring of electric energy between the frame support 105 and the base support 103 during rotation of the frame support in relation the base support. The result is that power signals and control signals can be transferred to the actuators 111 while the frame support 105 rotates. The shutter blades can thus be moved in and out the aperture 109 and adjust the shape of the light beam. The frame support can be rotated more than 360 degrees around in light beam and adjust the shape of the beam as desired. The limitations, in prior art framing systems, related to framing objects on a stage without the need to physical move the light fixture and/or reprogram the light controller are thus solved, as the framing support can be continuously moved around the light beam and the shutter blades can frame/shape the light beam as wanted. There are no need to consider the physical position of the light fixture, as the framing support can rotate continuously/endless around the light beam. A further surprising effect is the fact that the shape of the light beam can be adjusted while rotating the frame support and the result is that it is possible to create a varying beam shape that rotates continuously around its own axis. This makes it possible to create a new kind of light effect. It is further possible to construct a very compact framing system, since the actuators and shutter blades can be embodied in one plane, this is very useful in connection with light fixtures such as moving head light fixtures and spotlights including other parts for light effects. A compact framing system makes it for instance possible to place a traditional gobo wheel in close proximity to the shutter blades which enables a sharp image imaging of both the shutter blades and the gobo.

The rotatable electric connecting means comprises in the illustrated embodiment a number of one slip rings comprise a contact 303 and an electric conducting track 305. The electric conducting track are embodied on a printed circuit board (PCB) 307 secured to the second base support 103*b* and the contacts are secured to the frame support and connected to a PCB board on the frame support (not shown). The contacts are aligned with the electrical conducting tracks and adapted to be in contact with the tracks when the frame plate is positioned between the first and second support plates. As a consequence an electric connection between the track and the contact is established. The electrical conducting track surrounds the light beam and the contact will move along the track when the frame support rotates in relation to the base support.

The electrical conducting tracks can for instance be made of an electrical conducting metal, such as cobber where a hard metal have been added on top of the cobber track by soldering, plating or gilding process. The hard metal makes the electrical conducting track more robust against ware and corrosion and could for instance be hard gold, rhodium or platinum. The described solutions are only examples and the skilled person would be able to construct a large variety of electrical conduction tracks.

Figure 5:
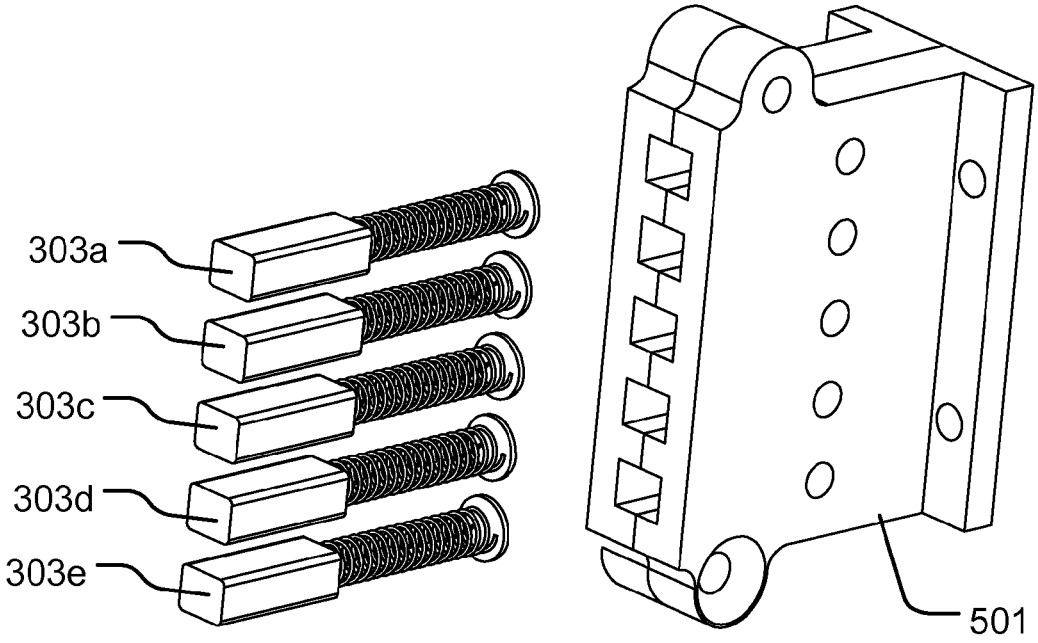
FIG. 5 illustrates an enlarge view of detail A of FIG. 4.

FIG. 5 illustrates an enlarged view of detail A in FIG. 4 and illustrates that five contacts 303*a*, 303*b*, 303*c*, 303*d*, 303*e* are placed in a housing 501. The housing is connected to a PCB board on the frame support and each contact is connected to one of the electrical conducting tracks on the base support. The shown framing system comprises two housing such that there are two contacts for each electrical conduction track this improves the contact and does further balance the frame support. However the skilled person realizes the amount of contacts pr. track can vary from a sigel contact pr. tract to any number of contacts pr. trackFour contacts pr. track can for instance be positioned symmetrical around the light beam resulting in a very balanced frame support.

Figure 6:
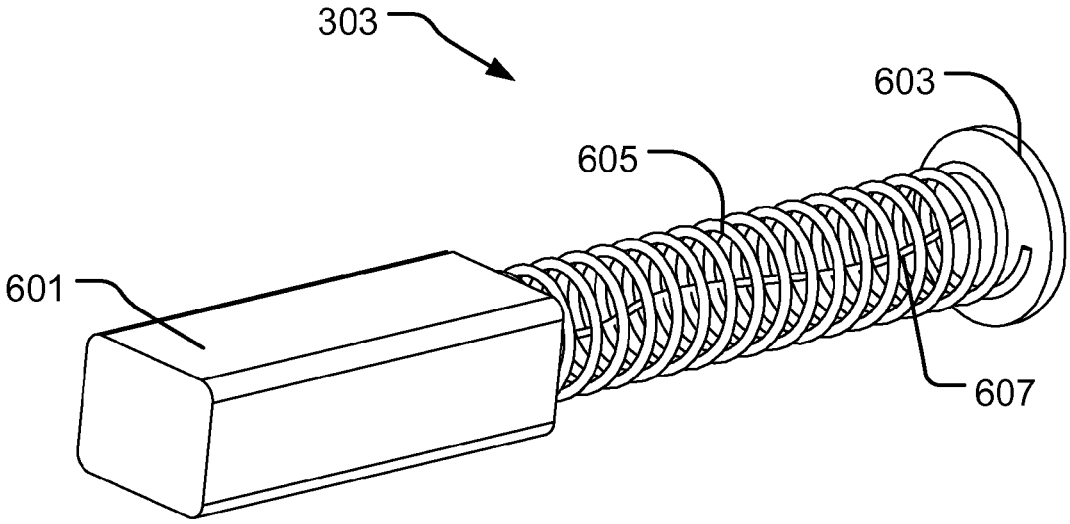
FIG. 6 illustrates a possible embodiment of a slip ring contact.

FIG. 6 illustrates a single contact 303 and illustrates that the contact comprises a contact head 601, a contact end 603, tensioning means 605 and a wire 607.

The tensioning means is embodied as a spring and pushes the contact head 601 towards the electrical conducting track. The tensioning means ensures that the contact head always will be in contact with the track even if the contact head by time gets worn out due to friction between the contact head and the track. The electric energy is transmitted from the contact head 601 to the contact end 605 through the wire. The contact end is in connection with conducting tracks on a PCB board on the frame support and the electric energy is distributed to the correct elements on the frame support. The contact head can be made of a soft material, such as a mixture of carbon and silver, in order to reduce wear of the electrical conducting track and friction between the track and contact.

Figures 7A, 7B:
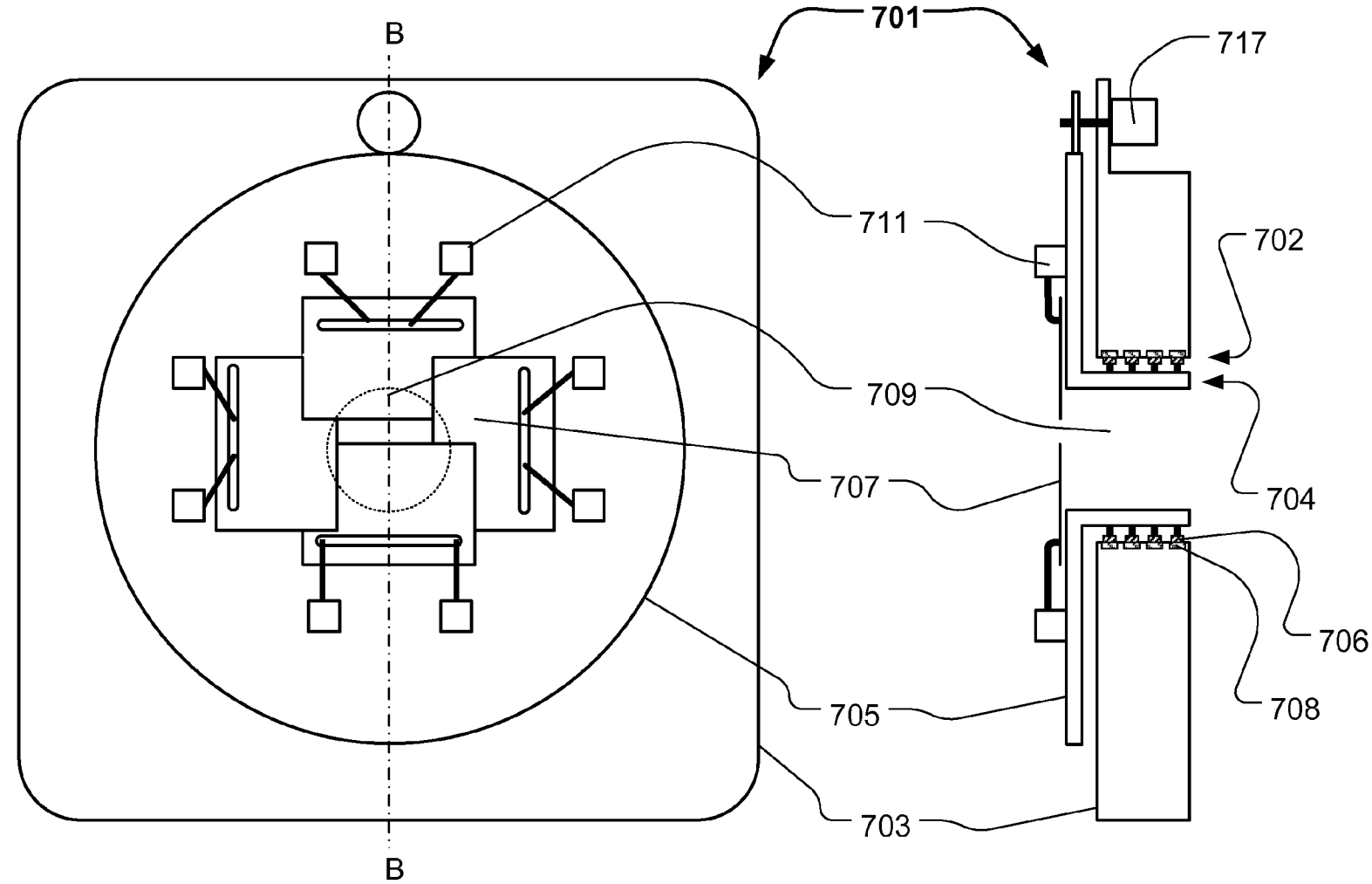
FIG. 7 illustrates another embodiment of the framing system according to the present invention.

FIG. 7 illustrates another embodiment of the framing system, where FIG. 7*a* illustrates a top view and FIG. 7*b* a cross sectional view along line B-B. The framing system 701 comprises a base support 703 rotatable supporting a frame support 705. The frame support comprises, a number of shutter blades 707 surrounding an aperture 709 for a light beam and a number of actuators 711 adapted to moved the shutter blades in and out of the aperture 709.

The frame support 705 can rotate more the 360 degrees in relation to the base support 703 and actuator 717 intermeshes with the frame support and can perform the rotation. The shutter blades 107 and actuators 109 can be embodied as known in the prior art and are merged in a pile as described above.

The rotatable electric connecting means are in this embodiment a number of slip rings. The electric conducting tracks are in this embodiment positioned inside the aperture on a cylindrical surface 702 and the contact are positioned on a accommodating cylindrical surface 704 on the frame support. The contacts 706 and electrical conducting track 708 interacts as described above.

The rotatable electric connecting means can also be embodied as a rotatable transformer transferring the electric energy using inductance. Wear and friction of such connection is reduced compared to the slip rings, as there do need to be a physical contact between the stationary part (base support) and the rotating part (frame support).

Figure 8:
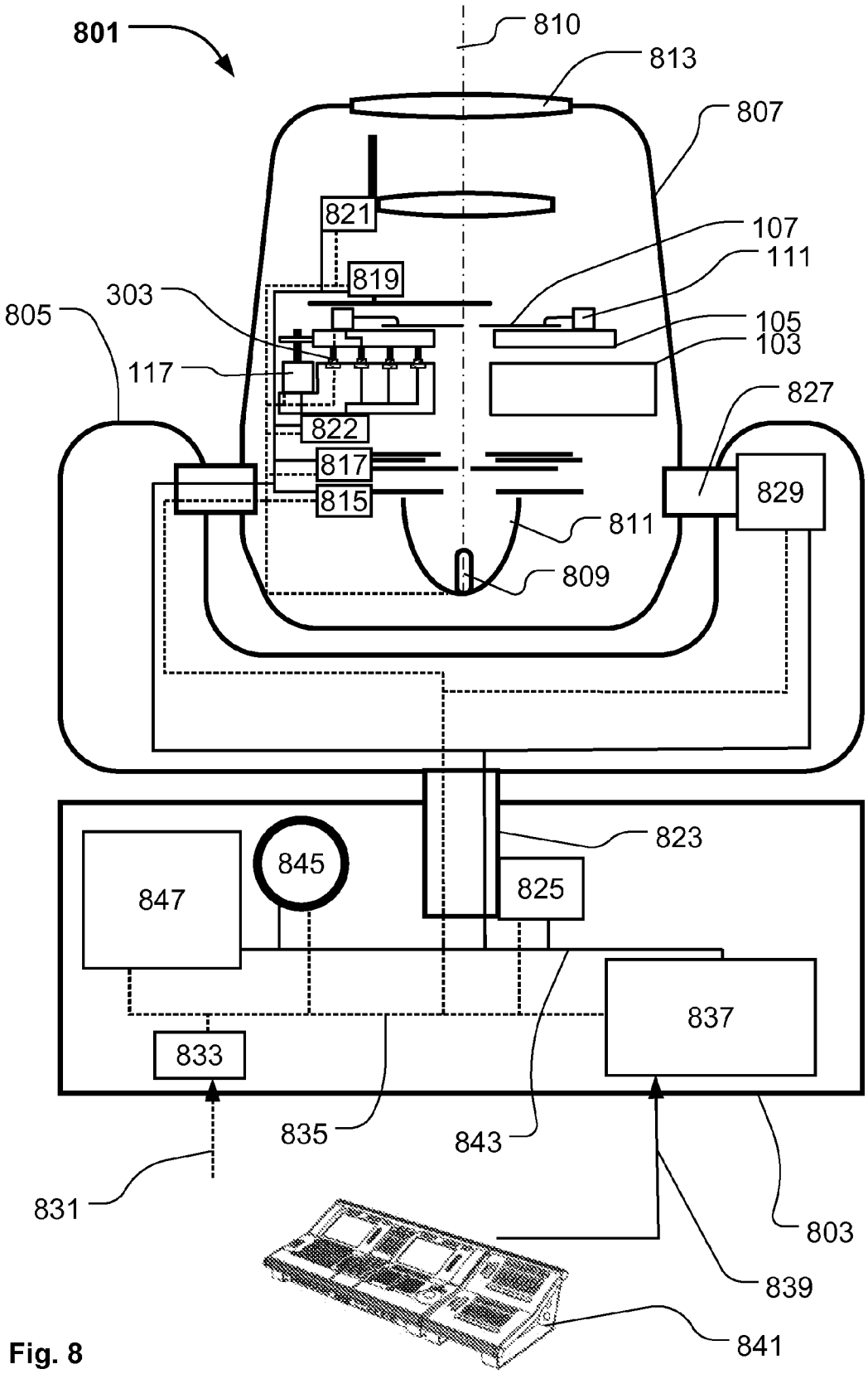
FIG. 8 illustrates a moving head light fixture comprising a framing system according to the present invention.

FIG. 8 is a structural diagram illustrating a moving head light fixture 801 according to the present invention. The moving head light fixture 801 comprises a base 803 connected to a yoke 805 and a head 807 carried in the yoke. The head comprises at least one light source 809 which generates a light beam (not shown) propagating along an optical axis 810. The light beam is reflected by a reflector 811 and passes through a number of light effects before exiting the head through a lens 813. The light effects could for instance be any light effects known in the art of intelligent lighting for instance a dimmer 815, a CMY color mixing system 817, color filters (not shown), gobos 819 and/or a zoom system 821.

The light effect can also be a framing system according to the present invention. The framing system comprises a base support 103 rotatable supporting a frame support 105 and an actuator 117 adapted to rotate the frame support. The frame support comprises a number of shutter blades 107 surrounding an aperture, through which the light beam passes. A number of actuators 111 are adapted to move the shutter blades in and out of the aperture and thus also in and out of the light beam the light beam. The framing system comprises also controlling means 822 adapted to control the framing system based on a received control signal as described below. The framing system comprises also a number of rotatable electric connecting means 303 for transferring power and controls signals from the base support to the frame support.

The light source can be any known light sources e.g. discharge lamps, LEDs, OLEDS, plasma lamps, lasers etc. The reflector can be any kind of reflectors and in some applications also be embodies as optical lenses such as TIR lenses.

The moving head light fixture comprises first rotating means for rotating the yoke in relation to the base, for instance by rotating a shaft 823 connected to the yoke by using a motor 825 positioned in the base. The moving head light fixture comprises also second rotating means for rotating the head in relation to the yoke, for instance by rotating a shaft 827 connected to the head by using a motor 829 positioned in the yoke. The skilled person would realize that the rotation means could be constructed in many different ways using mechanical components such as motors, shafts, gears, cables, chains, transmission systems etc.

The moving head light fixture receives electrical power 831 from an external power supply (not shown). The electrical power is received by an internal power supply 833 which adapts and distributes electrical power through internal power lines 835 (dotted lines) to the subsystems of the moving head. The internal power system can be constructed in many different ways and the illustrated power lines is for simplicity illustrated as one system where all subsystems are connected to the same power line. The skilled person would however realize that some of subsystems in the moving head need different kind of power and that a ground line also can be used. The light source will for instance in most applications need a different kind of power than step motors and driver circuits.

The light fixture comprises also a controller 837 which controls the other components (other subsystems) in the light fixture based on an input signal 839 indicative of at least one light effect parameter and at least one position parameter. The controller receives the input signal from a light controller 841 as known in the art of intelligent and entertainment lighting for instance by using a standard protocol like DMX, ArtNET, RDM etc. The light effect parameter is indicative of at least one light effect parameter of said light beam for instance the amount of dimming and/or the dimming speed of the light beam, a color that the CMY system 817 should mix, the kind of color filter that a color filter system (not shown) should position in the light beam and/or the kind of gobo that the gobo system 819 should position in the light beam, the divergence of the light beam that light fixture should create using a zoom system 821, a focus distance that indicate the distance form the lens to a surface where a gobo effect should be imaged, etc.

The light effect parameter can also be indicative of how the framing system should frame the light beam and can therefore comprises information of how each shutter blade should move in relation to the light beam, how the frame support should be rotated in relation the base support. The controller 837 receives the light parameter and sends commands to the controlling means 822 adapted to control the framing system. The controlling means 822 adapted to control the framing system will then instruct the actuators to activate the relevant parts as instructed and the descried framing effect is achieved.

The controller is adapted to send commands and instructions to the different subsystems of the moving head through internal communication lines 843 (solid lines). The internal communication system can be based on a various type of communications networks/systems and the illustrated communication system is just one illustrating example.

The position parameter is indicative of rotation of at least said yoke in relation to said base and/or rotation of said head in relation to said yoke. The position parameter could for instance indicate a position whereto the light fixture should direct the beam, the position of the yoke in relation to the base, the position of the head in relation to the yoke, the distance/angle that the yoke should be turned in relation to the base, the distance/angle that the head should be turned in relation the base etc. The rotation parameter could also indicate the speed and time of the rotation.

The moving head could also have user input means enabling a user to interact directly with the moving head instead of using a light controller 841 to communicate with the moving head. The user input means 845 could for instance be bottoms, joysticks, touch pads, keyboard, mouse etc. The user input means could also be supported by a display 847 enabling the user to interact with the moving head through menu system shown on the display using the user input means 847. The display device and user input means could in one embodiment also be integrated as a touch screen.

The present invention relates also to a method for delimiting a light beam using a framing system comprises a base support rotatable supporting a frame support, where the frame support comprises a number of shutter blades surrounding said light beam and a number of actuators adapted to moved said shutter blades in and out of said light beam.

The method comprises the step of:

moving at least one of said shutter blade in and out of said light beam using said actuator;

rotating the shutter blades around blade around said light beam by rotating said frame support, where the step of rotating the shutter blade around the light beam comprises the steps of rotating the frame support at least 360 degrees and transferring electric energy between said frame support and said base support. It is hereby achieved that several light effects can be created as the shape of the light beam can be changes and continuously/endless rotated.

The invention claimed is:

1. A framing system for delimiting a light beam, said framing system comprising a base support rotatably supporting a frame support, said frame support comprising:

a number of shutter blades surrounding said light beam; and a number of actuators adapted to move said shutter blades in and out of said light beam;

wherein the framing system comprises rotatable electric connecting means, said rotatable electric connecting means enables transferring of electric energy between said frame support and said base support during rotation of said frame support in relation to said base support.

2. The framing system according to claim 1, wherein said rotatable electric connecting means comprises at least one slip ring comprising a contact and an electric conducting track, said contact being adapted to move along said electric conducting track.

3. The framing system according to claim 2, wherein said electric conducting track surrounds said light beam.

4. The framing system according to claim 2, wherein said contact comprises tensioning means pushing said contact towards said electrical conducting track.

5. The framing system according to claim 1, wherein said rotatable electric connecting means comprises a rotatable transformer.

6. The framing system according to claim 1, wherein said rotatable electric connecting means transfers at least one power signal between said base support and said support frame.

7. The framing system according to claim 1, wherein said rotatable electric connecting means transfers at least one control signal between said base support and said support frame.

8. A light fixture comprising a light source generating a light beam wherein said light fixture comprises a framing system according to claim 1.

9. The light fixture according to claim 8, wherein said light source and said framing system are positioned in a head, said head being rotatable to a yoke, said yoke being rotatable to a base.

10. A method for delimiting a light beam using a framing system, where the framing system comprises a base support rotatably supporting a frame support, said frame support comprising:

a number of shutter blades surrounding said light beam; and a number of actuators adapted to move said shutter blades in and out of said light beam;

said method comprising the steps of:

moving at least one of said shutter blades in and out of said light beam using said actuator;

rotating said shutter blades around said light beam by rotating said frame support;

wherein said step of rotating said shutter blade around said light beam comprises the steps of:

rotating said frame support at least 360 degrees; and transferring electric energy between said frame support and said base support.

* * * * *